US006976876B1

(12) United States Patent
Su et al.

(10) Patent No.: US 6,976,876 B1
(45) Date of Patent: Dec. 20, 2005

(54) CONNECTOR WITH REDUCED ELECTROMAGNETIC INTERFERENCE

(75) Inventors: Chia Sheng Su, Tucheng (TW); Bo Liu, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 11/060,412

(22) Filed: Feb. 18, 2005

(51) Int. Cl.[7] ..... H01R 13/648
(52) U.S. Cl. ..... 439/607; 439/357
(58) Field of Search ..... 439/350–358, 439/607, 731, 906

(56) References Cited

U.S. PATENT DOCUMENTS 6,099,339 A * 8/2000 Yanagida et al. ..... 439/358
6,413,112 B2 * 7/2002 Semmeling et al. ..... 439/358
6,454,592 B2 * 9/2002 Takagi ..... 439/378
6,457,987 B1 * 10/2002 Yeh ..... 439/352
6,540,542 B1 * 4/2003 Simmel ..... 439/352
6,865,369 B2 * 3/2005 Semmeling et al. ..... 434/357

* cited by examiner

*Primary Examiner*—Khiem Nguyen
(74) *Attorney, Agent, or Firm*—Rosenberg, Klein & Lee

(57) ABSTRACT

A connector for reducing electromagnetic interference includes a top shielded cover, a bottom shielded cover, a positioning mechanism and a transmit slice. Both of the top shielded cover and the bottom shielded cover are engaged with each other. The positioning mechanism includes a pair of transmit slices and lock members. The lock members lie on the top of the top shielded cover. The side of the bottom shielded cover is inserted between the lock member and the side of the top shielded cover. The transmit slice is a cantilever slice which is located at the side of the top shielded cover.

9 Claims, 6 Drawing Sheets

CONNECTOR WITH REDUCED ELECTROMAGNETIC INTERFERENCE

BACKGROUND OF THE INVENTION

1. Field of the Invention

The present invention relates generally to an electronic connector, and more especially to an electronic connector for reducing electromagnetic interference.

2. The Related Art

At present, a connector is wrapped by a metal cover which is connected to a ground cover, for reducing electromagnetic interference in the field of the electronic connector. While the connector, such as the connector of a mobile phone, for transmitting the high frequency, the metal cover is necessary in order to insure the qualities of transmission.

U.S. Pat. No. 6,413,112 issued on Jul. 2, 2004 discloses a plug connector for mobile phone. The plug connector comprises a plastic inner cover, a top shielded cover, a bottom shielded cover, a plurality of terminals and a ground mechanism. The terminals are arranged within the plastic inner cover. The top shielded cover and the bottom shielded cover engage with each other and enclosure the plastic inner cover. The circuit board is provided with a ground circuit. The bottom shielded cover inwardly extends an elastic tip at rear end which links to the ground circuit of the circuit board. Both of the top shielded cover and the bottom shielded cover are under ground contact status for reducing electromagnetic interference.

In the above-mentioned connector, a press section is arranged and linked on the plastic cover. A pair of fixing poles is formed in the front of the plastic cover. A latch blade is received in the fixing pole. When the press section of the top cover is pressed, the latch blade is downwardly moved in order to engage and disengage with another connector.

The connector is connected to another connector. When the connector engages and disengages with another connector repeatedly, the top and bottom shielded covers of the connector don't buckle together tightly. There is a chink between the engaged connectors, the electromagnetic interference can not be avoided completely.

SUMMARY OF THE INVENTION

Thus, a main object of the present invention is to provide an electronic connector for reducing electromagnetic interference. The electronic connector comprises a top and a bottom shielded covers which are stably, steadily engaged with each other. Both of the top shielded cover and the bottom shielded cover are under shielded status and ground contact status.

A further object of the present invention is to provide an electronic connector for reducing electromagnetic interference, in which a fixing pole is formed on the inner cover and wrapped by the top and bottom shielded covers, so that the strength of the fixing pole is reinforced.

To attain the main object, the present invention provides an electronic connector for reducing electromagnetic interference comprising a plastic cover, a top shielded cover, a bottom shielded cover, a plurality of terminals, a positioning mechanism and a ground mechanism. A plurality of terminals is arranged within the plastic cover. The top and bottom shielded covers are received by the plastic cover. The ground mechanism is connected to one of the top and bottom shielded covers. The top shielded cover and the bottom shielded cover are engaged with each other by the positioning mechanism. Both of the top shielded cover and the bottom shielded cover are under ground contact status. The positioning mechanism includes a lock member and a transmit slice, and the lock members are curved panels which lie on the top of the top shielded cover, the side of the bottom shielded cover is arranged between the lock member and the side of the top shielded cover. The lock member clips on the side of the bottom shielded cover, and pushes toward the bottom shielded cover. The transmit slice is placed on the side of the top shielded cover or the bottom shielded cover. There is a conduct bulge section that is projected from the transmit slice, the conduct bulge section is pushed toward the bottom shielded cover or the top shielded cover.

To attain the further object, the plastic cover of the connector of the invention comprises a top cover and a bottom cover which is engaged with the top cover. The top shielded cover is firmly received between the inner cover and the top cover. The bottom shielded cover is firmly received between the inner cover and the bottom cover. A plurality of terminals is arranged within the inner cover. A fixing pole is formed in the front of the inner cover. A latch blade is received in the fixing pole which is engaged and disengaged with another connector.

According to the invention, the positioning mechanism of the connector of the invention further comprises a buckled mechanism. The buckled mechanism includes a buckle slot which lies on the top of shielded cover and a buckle slice which is installed on the bottom shielded cover. The buckle slice inserts into the buckle slot for buckling.

According to the invention, the ground mechanism includes a circuit board which is received between the top shielded cover and the bottom shielded cover. The circuit board is connected to the outer cable wires for the signal transmission. The circuit board is a printed ground circuit. The bottom shielded cover inwardly extends an elastic tip at rear end which links to the ground circuit of the circuit board.

As above-illustrated, the conduct bulge section by means of the elasticity of the transmit slice is pushed toward the bottom shielded cover inwardly. The lock member clips the bottom shielded cover, so that the top and bottom shielded covers are stably, steadily engaged with each other. In addition, the fixing pole is formed on the inner cover, and wrapped by the top and bottom shielded covers, so that the strength of the fixing pole is reinforced. In order to allow the top and bottom shielded covers buckled together.

BRIEF DESCRIPTION OF THE DRAWINGS

A detailed explanation of a preferred embodiment of the present invention will be given, with reference to the attached drawing, for better understanding thereof to those skilled in the art.

DETAILED DESCRIPTION OF THE PREFERRED EMBODIMENT

In order to illustrate the present invention particularly, including technology, structure trait, aims and efficiency, a detailed explanation of a preferred embodiment of the present invention will be given thereinafter, with reference to the attached drawing, for better understanding thereof to those skilled in the art.

Figure 1:
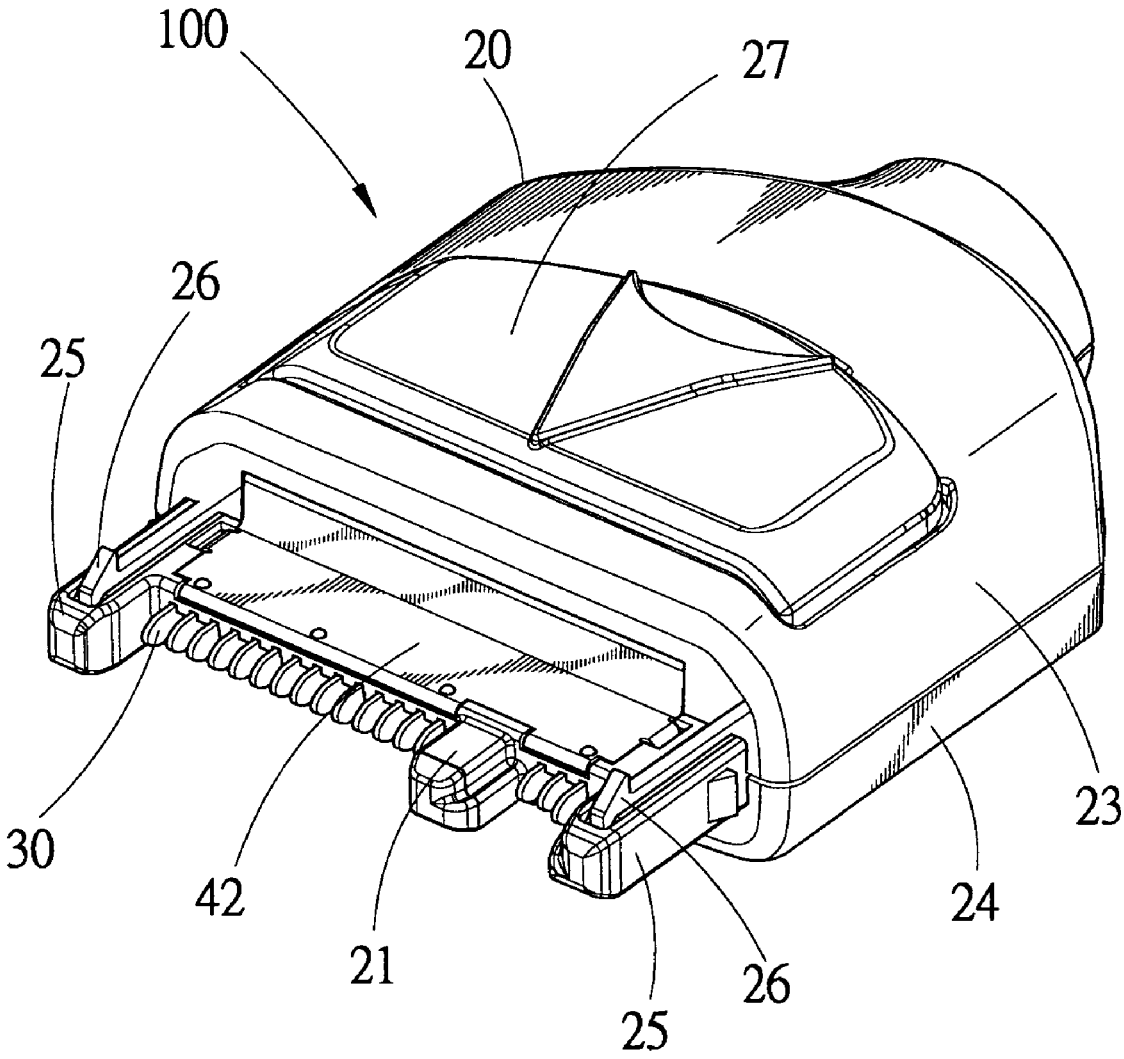
FIG. 1 is a perspective view of a connector with reduced electromagnetic interference of the invention.
Figure 2:
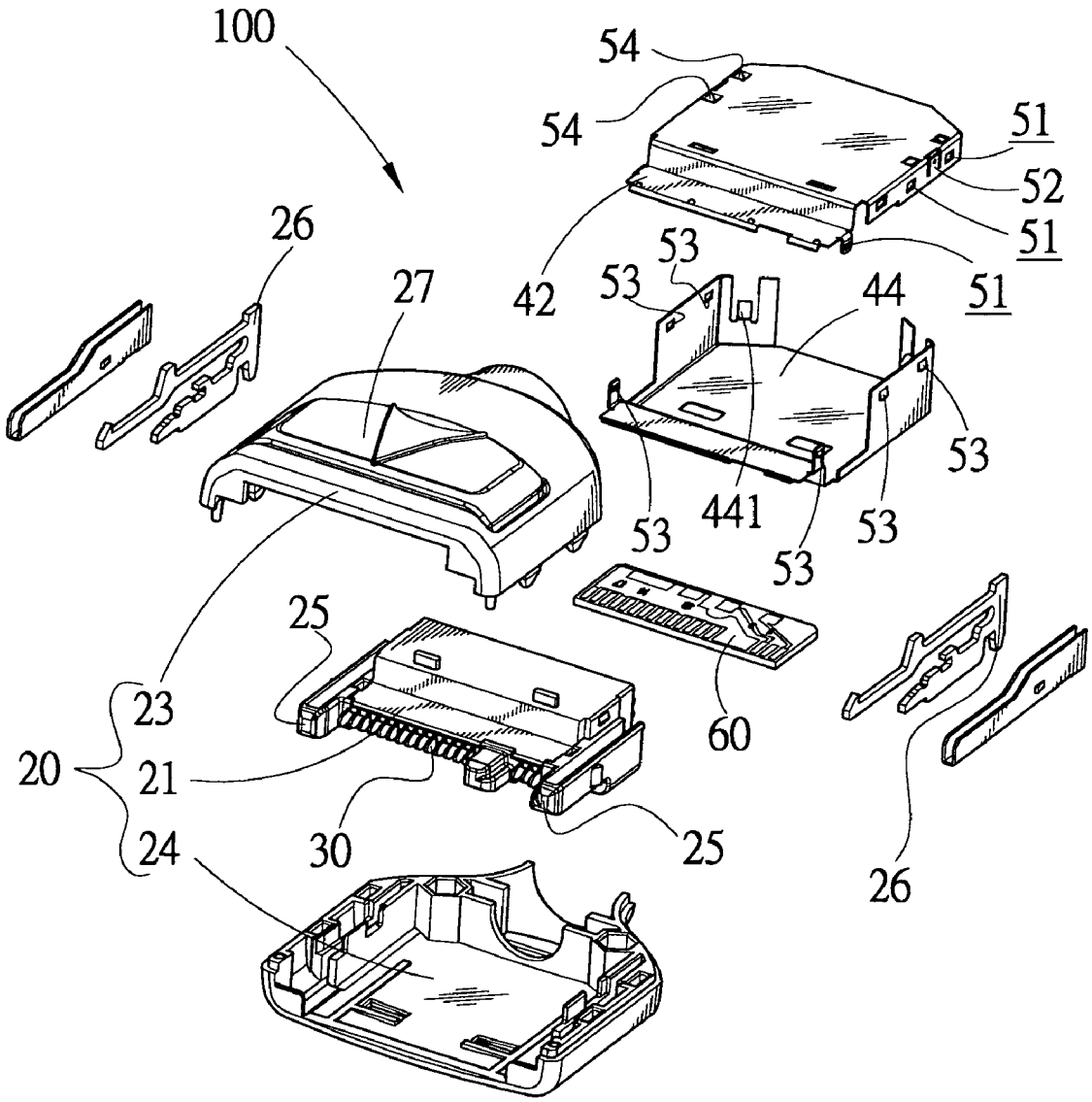
FIG. 2 is an exploded view of a connector with reduced electromagnetic interference of the invention.
Figure 3:
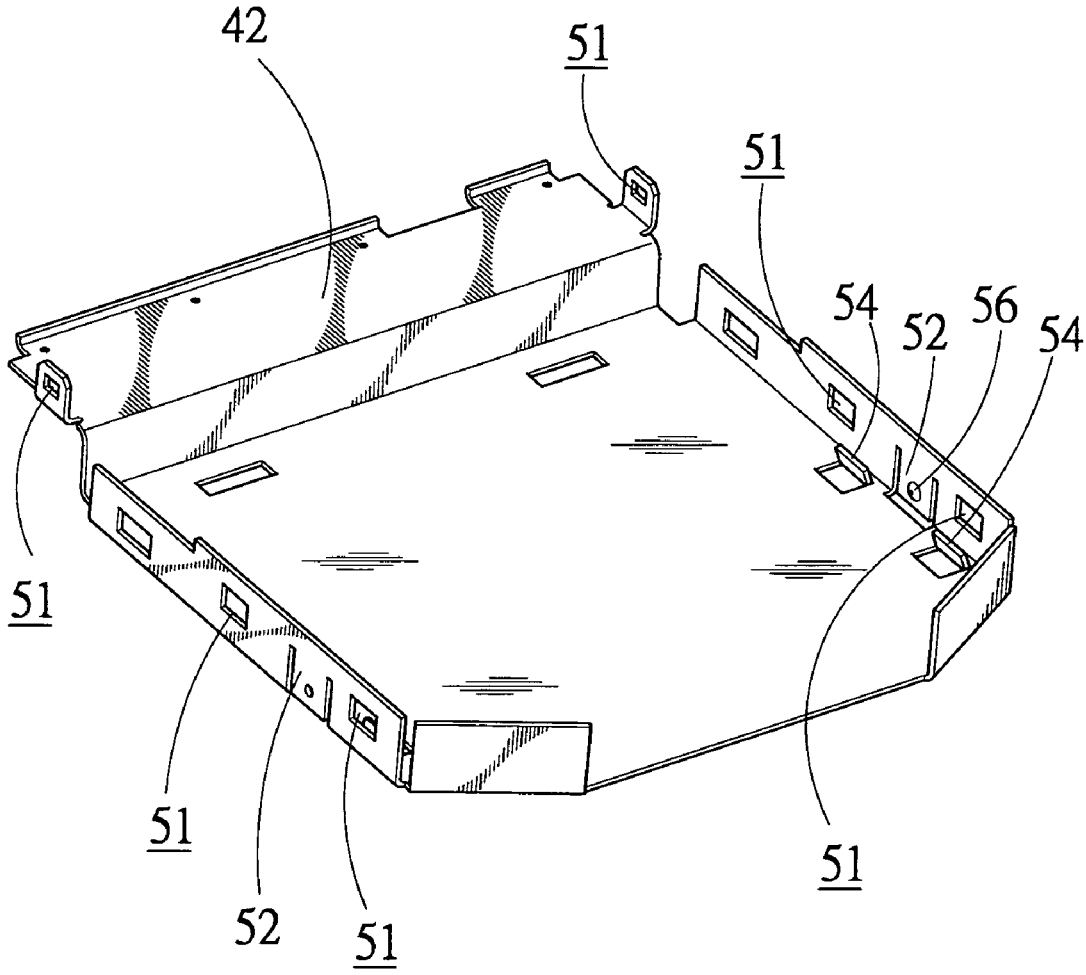
FIG. 3 is a perspective view of the top shielded cover in accordance with the present invention.
Figure 4:
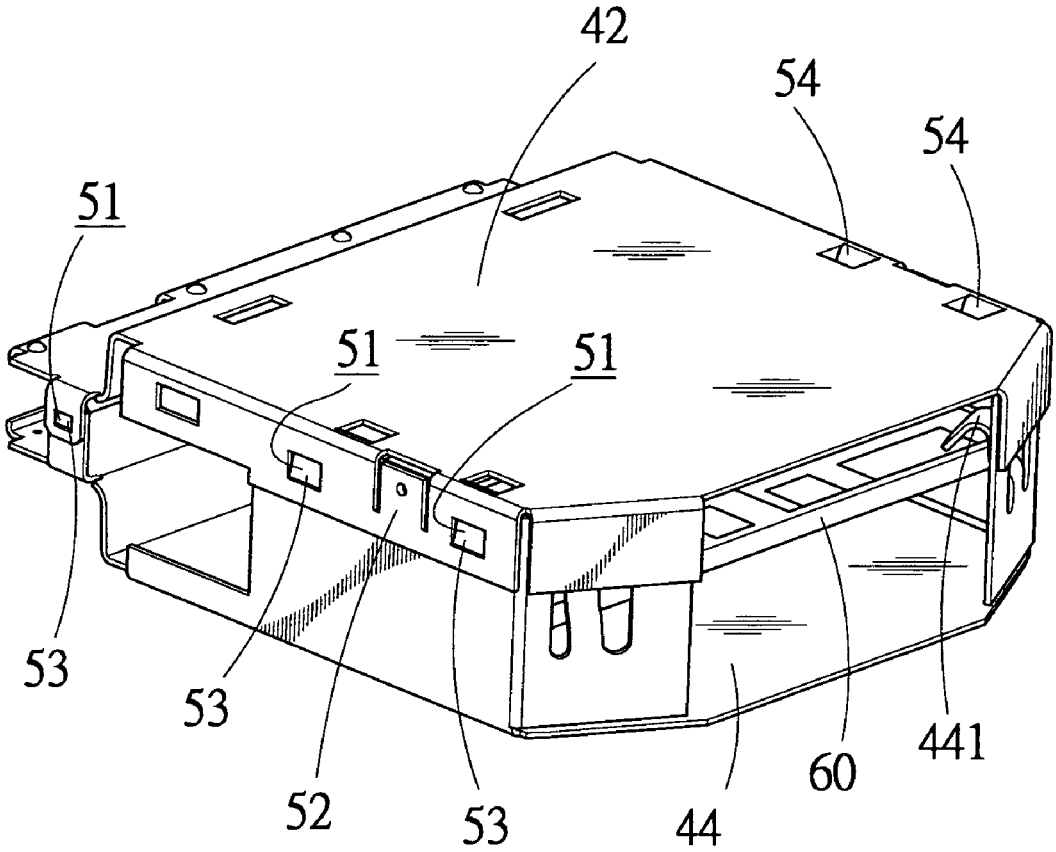
FIG. 4 is a perspective view of the top and bottom shielded covers in accordance with the present invention.

With reference to FIGS. 1 and 2, a connector with reduced electromagnetic interference of the present invention, generally designed with reference numeral 100, comprises plastic cover 20, a top shielded cover 42, a bottom shielded cover 44, a plurality of terminals 30, a positioning mechanism and a ground mechanism. The plastic cover 20 comprises an inner cover 21, a top cover 23 and a bottom cover 24 which is engaged with the top cover 23. The top shielded cover 42 is firmly received between the inner cover 21 and the top cover 23. The bottom shielded cover 44 is firmly received between the inner cover 21 and the bottom cover 24. A plurality of terminals 30 is arranged within the inner cover 21.

Figure 5:
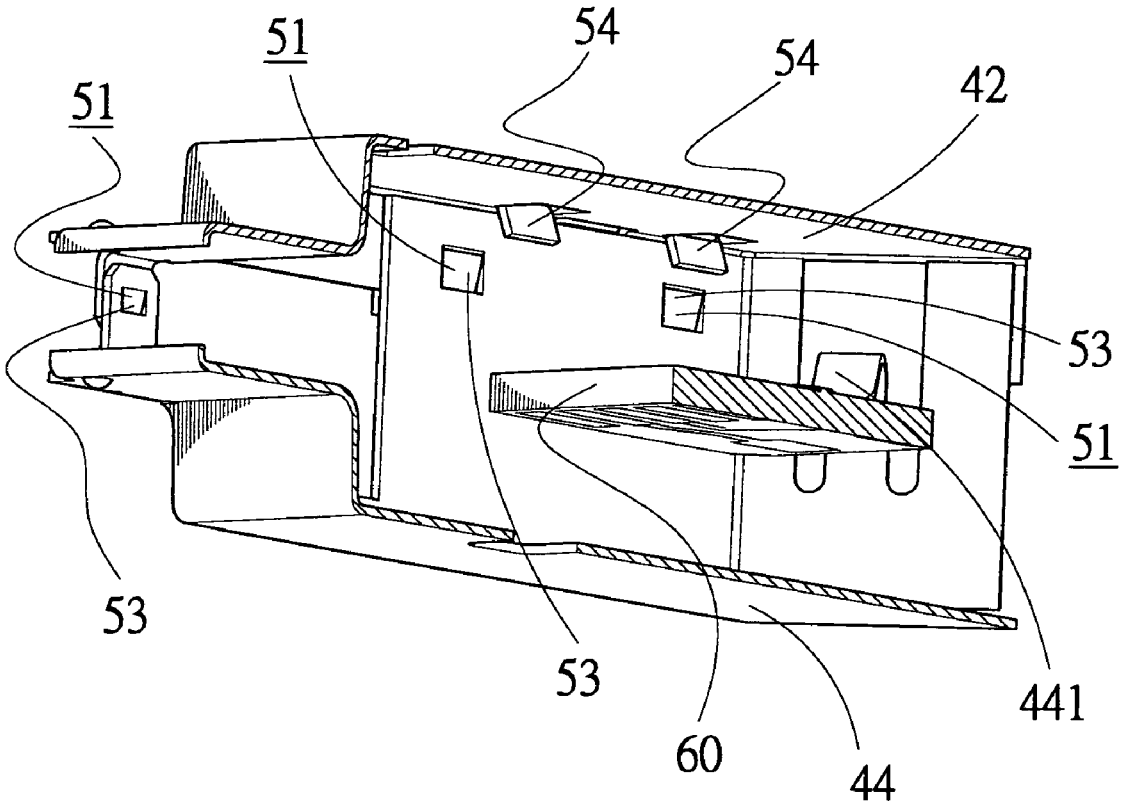
FIG. 5 is a cross-sectional view of the top and bottom shielded covers in accordance with the present invention.

Referring to FIGS. 1, 2 and 5, the ground mechanism includes a circuit board 60 which is received between the top shielded cover 42 and the bottom shielded cover 44. The circuit board 60 is connected to the outer cable wires (not shown) for the signal transmission. The circuit board 60 is a printed ground circuit. The bottom shielded cover 44 inwardly extends an elastic tip 441 at rear end which links to the ground circuit of the circuit board 60. Since the top shielded cover 42 and the bottom shielded cover 44 are engaged with each other, both of the top shielded cover 42 and the bottom shielded cover 44 are under ground contact status.

As shown in FIG. 3 to FIG. 6, the positioning mechanism includes a pair of transmit slices 52 and lock members 54 which are formed at both sides of each transmit slice 52. The transmit slice 52 is a cantilever slice which is located at the side of the top shielded cover 42. One end of the transmit slice 52 is a fixed end and the other is a free end. There is a circular bulge section 56 that is projected from the transmit slice 52. The lock members 54 are curved panels which lie on the top of the top shielded cover 42 and downwardly inclined to obtain a better rigidity.

When assembling, the side of the bottom shielded cover 44 is inserted into the side of the top shielded cover 42 and placed between the side of the top shielded cover 42 and the lock member 54. The conduct bulge section 56 by means of the elasticity of the transmit slice 52 is pushed toward the bottom shielded cover 44 inwardly. The lock member 54 clips the bottom shielded cover 42, so that the top and bottom shielded covers 42, 44 are stably, steadily engaged with each other.

Figure 6:
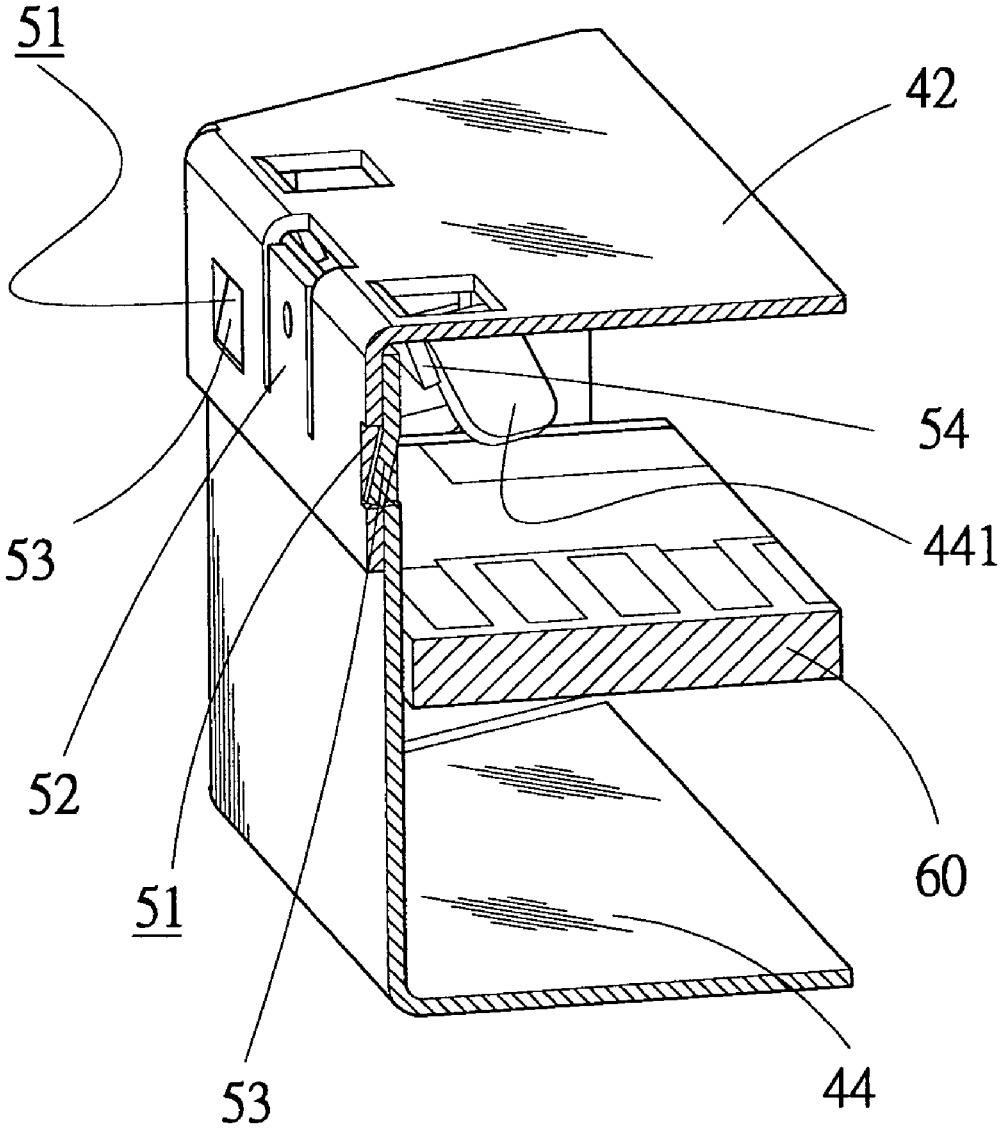
FIG. 6 is another cross-sectional view of the top and bottom shielded covers in accordance with the present invention.

As shown in FIG. 6, the fixed position mechanism further comprises a buckled mechanism. The buckled mechanism includes a buckle slot 51 which locates on the top of shielded cover 42 and a buckle slice 53 which locates under the bottom shielded cover 44. The buckle slice 53 inserts into the buckle slot 51 in order to allow the top and bottom shielded covers 42, 44 buckled together.

Referring to FIG. 2 again, a press section 27 is arranged and linked on the top cover 23. A pair of fixing poles 25 is formed in the front of the inner cover 21. A latch blade 26 is engaged and received in the fixing pole 25. When the press section 27 of the top cover 23 is pressed, the latch blade 26 is downwardly moved in order to engage or disengage with another connector (not shown). The fixing pole 25 is formed on the inner cover 21, and wrapped by the top and bottom shielded covers 42, 44, so that the strength of the fixing pole 25 is reinforced.

In the above-mentioned preferred embodiment of the invention, the positioning mechanism can be replaced by other designs. For example, the transmit slice 52 can be arranged on the bottom shielded cover 44. The lock member 54 of the top shielded cover 42 is curved outwardly. The buckle slot 51 is designed on the bottom shielded cover 44, the buckle slice 53 is designed on the top shielded cover 42. These additional designs provide similar function as the above-mentioned embodiment.

While the present invention has been described with reference to a specific embodiment thereof, the description is illustrative and is not to be construed as limiting the invention. Various modifications to the present invention may be made to the preferred embodiment by those skilled in the art without departing from the true spirit and scope of the invention as defined by the appended claims.

What is claimed is:

1. A connector for reducing electromagnetic interference comprising:

a plastic cover including an inner cover, a top cover and a bottom cover which is engaged with the top cover;

a top shielded cover being firmly received between the inner cover and the top cover;

a bottom shielded cover being firmly received between the inner cover and the bottom cover;

a plurality of terminals being arranged within the inner cover;

a ground mechanism connecting to the top and bottom shielded covers, so that both of the top shielded cover and the bottom shielded cover are under ground contact status; and a positioning mechanism including a plurality of transmit slices and a plurality of lock members which are formed at both sides of each transmit slice; the transmit slice being a cantilever slice which is located at the side of the top shielded cover, one end of the transmit slice being a fixed end and the other being a free end; a circular bulge section being projected from the transmit slice; the lock members lying on the top of the top shielded cover and downwardly inclining so that the bottom shielded cover is firmly engaged between the top shielded cover and the lock members.

2. The connector for reducing electromagnetic interference according to claim 1, wherein the inner cover further comprises a pair of fixing poles formed in the front of the inner cover and a pair of latch blades being engaged and received in the fixing poles respectively to engage with another connector.

3. The connector for reducing electromagnetic interference according to claim 1, wherein the positioning mechanism further comprises a buckled mechanism, the buckled mechanism includes a buckle slot which lies on the top of shielded cover and a buckle slice which locates under the bottom shielded cover, the buckle slice inserts into the buckle slot so that the top and bottom shielded covers are buckled together.

4. The connector for reducing electromagnetic interference according to claim 1, wherein the lock members are downwardly and inwardly curved panels which lie on the top of the top shielded cover.

5. The connector for reducing electromagnetic interference according to claim 1, wherein the lock members are downwardly and outwardly curved panels which lie on the top of the top shielded cover.

6. The connector for reducing electromagnetic interference according to claim 1, wherein the positioning mechanism includes a pair of transmit slices which are placed on the lateral of the transmit slice.

7. The connector for reducing electromagnetic interference according to claim 1, wherein the positioning mechanism is arranged on the side of the top shielded cover.

8. The connector for reducing electromagnetic interference according to claim 1, wherein the positioning mechanism is arranged on the side of the bottom shielded cover.

9. The connector for reducing electromagnetic interference according to claim 1, wherein the ground mechanism includes a circuit board which is received between the top shielded cover and the bottom shielded cover, the circuit board is connected to outer cable wires for the signal transmission, the circuit board is a printed ground circuit, the bottom shielded cover inwardly extends an elastic tip at rear end which links to the ground circuit of the circuit board.

* * * * *